United States Patent [19]

Lee et al.

[11] 4,444,590

[45] Apr. 24, 1984

[54] CALCIUM-SLAG ADDITIVE FOR STEEL DESULFURIZATION AND METHOD FOR MAKING SAME

[75] Inventors: Douglas C. Lee, Pittsburgh; Leon A. Luyckx, New Castle, both of Pa.

[73] Assignee: ESM Incorporated, Valencia, Pa.

[21] Appl. No.: 479,129

[22] Filed: Mar. 28, 1983

[51] Int. Cl.[3] ..... C22B 9/10

[52] U.S. Cl. ..... 75/257; 75/53

[58] Field of Search ..... 75/257, 53

[56] References Cited

U.S. PATENT DOCUMENTS

| | | | |
|---|---|---|---|
| 3,551,137 | 12/1970 | Bhat | 75/10 R |
| 3,575,695 | 4/1971 | Miyashita | 75/53 |
| 3,779,739 | 12/1973 | Adachi | 75/257 |
| 3,950,163 | 4/1976 | Nafziger | 75/257 |
| 4,060,406 | 11/1977 | Jones | 75/257 |
| 4,180,397 | 12/1979 | Naylor | 75/53 |
| 4,209,325 | 6/1980 | Cooper | 75/257 |
| 4,286,984 | 9/1981 | Luyckx | 75/58 |
| 4,317,678 | 3/1982 | Faulring | 75/53 |

FOREIGN PATENT DOCUMENTS

| | | | |
|---|---|---|---|
| 480658 | 2/1938 | United Kingdom | 75/53 |

*Primary Examiner*—Peter D. Rosenberg

*Attorney, Agent, or Firm*—Parmelee, Miller, Welsh & Kratz

[57] ABSTRACT

A calcium-slag additive for use in desulfurization of molten steel contains, by weight, 10–25 percent calcium metal, 30–50 percent fluorspar, 10–30 percent aluminum oxide and 10–30 percent calcium oxide. The calcium-slag is produced by forming a molten mixture of lime, fluorspar and aluminum in a graphite-lined induction furnace and heating the mixture to 1300°–1600° C. to form a calcium-aluminum alloy phase floating on a calcium-slag phase, and tapping the calcium-slag from the bottom of the furnace and rapidly cooling the same to form a solid calcium-slag material.

11 Claims, 1 Drawing Figure

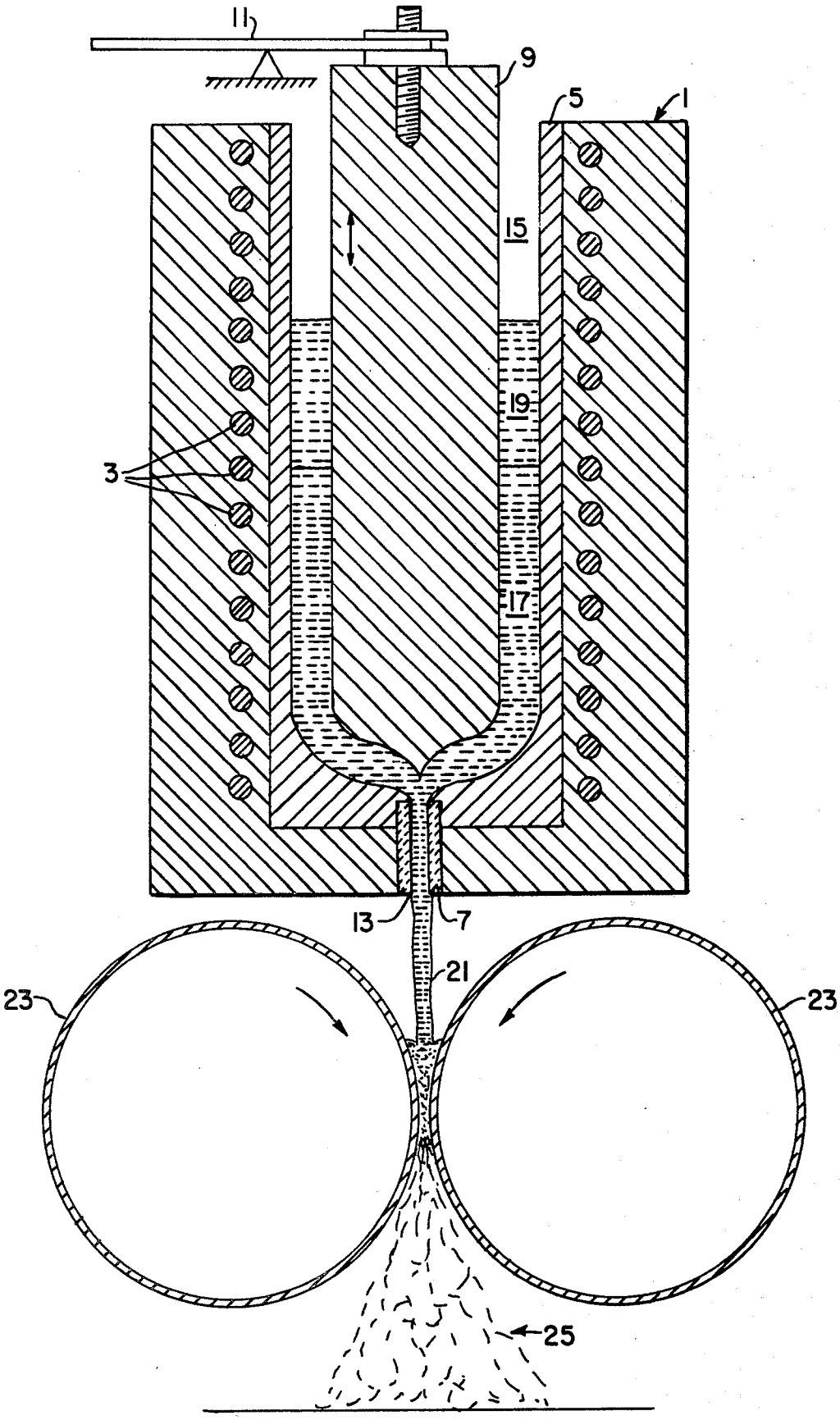
11
9
5
1
15
19
3
17
13
7
21
23
23
25

CALCIUM-SLAG ADDITIVE FOR STEEL DESULFURIZATION AND METHOD FOR MAKING SAME

The present invention relates to a calcium metal-slag additive for use in steel desulfurization and to a method for producing the additive.

The need exists for a desulfurization additive for molten steel that provides a silicon-free and carbon-free source of calcium, which additive provides the calcium metal in an inexpensive form.

Numerous processes have been advanced which utilize the benefits of lime, fluorspar, aluminum oxide, calcium metal or alloys, and other reactants in the treatment of ferrous melts. Examples of such processes are U.S. Pat. No. 3,551,137 which teaches use of a flux for electroslag remelting, which contains calcium fluoride, aluminum oxide and a mixture of calcium oxide and magnesium oxide: and U.S. Pat. No. 3,779,739 which teaches a deoxidation and desulfurization process using a flux of calcium oxide and aluminum oxide, or calcium oxide and calcium fluoride, in combination with other oxides in an arc furnace system. A further quaternary flux composition for electroslag remelting is taught in U.S. Pat. No. 3,950,163 which flux consists of calcium oxide, calcium fluoride, magnesium oxide and aluminum oxide.

In U.S. Pat. No. 4,097,269, a process for desulfurization of low oxygen content steel melts is disclosed, where a prefused, highly basic slag is injected into the steel melt. The prefused slag is formed by mixing and melting calcium oxide and calcium fluoride with 0–40 percent aluminum oxide and less than 20 percent silicon dioxide, as well as less than 5 percent of the heavy metal oxides, such as Fe-, Mn-, and Cr-oxides.

None of the above-described processes use calcium metal or alloy as a component of the additive. The use of calcium metal or alloy injection into steel melts has been suggested, for example in U.S. Pat. No. 3,575,695 which teaches a deoxidation method for molten steel wherein, following addition of a deoxidizer to the molten steel, about 0.05 percent by weight of the steel of calcium, or a calcium alloy, is blown into the lower part of the vessel to reduce the amount and size of the nonmetallic inclusions in the steel. Also, in U.S. Pat. No. 4,286,984, an alloy for use in desulfurization of molten steel is disclosed, which alloy consists essentially of calcium, aluminum, and 5–60 percent of iron and/or manganese, with the alloy injected into the molten steel bath.

In the present invention, a calcium metal-containing slag composition is prepared which provides calcium metal inexpensively, by the partial reduction of burnt lime by aluminum metal at high temperatures. Calcium-aluminum alloys have previously been prepared by methods such as are described in U.S. Pat. No. 2,190,290 and British patent 480,658. In U.S. Pat. No. 2,190,290, a calcium-aluminum alloy is produced by adding lime to the top of a molten aluminum bath, the lime sinking to form a calcium-aluminum alloy that floats on a calcium-aluminate slag. Alloy may be tapped from the upper portion of the furnace and slag is tapped from the bottom portion of the furnace. In British patent 480,658, aluminum and briquettes of lime and aluminum are heated to form a calcium-aluminum alloy and a slag. Neither of these prior references, however, use fluorspar in the calcium-aluminum alloy production process.

We have found that a calcium metal-slag that is useful in desulfurization of steel can be produced with high calcium contents where fluorspar is added to a lime-aluminum melt. The fluorspar enables solubilizing of calcium at temperatures above 1400° C., such that higher amounts of calcium metal can be incorporated into the slag product.

SUMMARY OF THE INVENTION

A solid calcium-slag additive for use in desulfurizing molten steel contains 10–15 percent by weight calcium metal, 30–50 percent by weight fluorspar, 10–30 percent by weight aluminum oxide and 10–30% by weight calcium oxide, with less than about 1O percent by weight of impurities such as silicon dioxide, magnesium oxide and calcium carbide. The solid calcium-slag additive is produced by forming a molten mixture of lime, fluorspar and aluminum in a graphite-lined induction furnace, under an inert atmosphere, and heating the mixture to 1300°–1600° C. to form a top layer of calcium-aluminum alloy and a bottom layer of calcium-slag. The calcium-slag is tapped from the bottom of the furnace and rapidly cooled to form a solid calcium-slag additive for desulfurizing of molten steel. A particularly useful process uses a graphite lined induction furnace and a central graphite stopper rod, with an annular bath of the two molten phases formed, and the slag is tapped from the bottom of the furnace onto chilling copper rolls.

BRIEF DESCRIPTION OF THE DRAWING

The drawing is a cross-sectional view of an apparatus for carrying out the present process, with the contents of the furnace shown at the time of tapping of the calcium-slag material.

DETAILED DESCRIPTION

A solid calcium-slag additive material useful as a desulfurizing agent for molten steel contains calcium metal in admixture with fluorspar, $CaF_2$, aluminum oxide $Al_2O_3$, lime, CaO, in particular percentages by weight of the mixture. Minor amounts of other compounds, in the form of impurities, such as silicon dioxide, magnesium oxide and calcium carbide may also be present.

The solid calcium-slag additive consists essentially of the following, by weight:

Ca (metal):10–25%
$CaF_2$:30–50%
$Al_2O_3$: 10–30%
CaO:10–30%
$SiO_2+MgO+CaC_2$:1–10%

The $SiO_2$, MgO, and $CaC_2$ are primarily the result of impurities normally present in lime and fluorspar used in the formation of the calcium-slag additive material and remain in the calcium-slag material formed.

A particularly useful calcium-slag additive material produced according to the present invention contains the following by weight:

Ca (metal):15
$CaF_2$:45
$Al_2O_3$:20
CaO:18
$SiO_2+MgO+CaC_2$:2

The solid calcium-slag additive material is in a finely divided form, so as to be readily injectable into the bath of molten steel. In order to be injectable, the solids should be −35 mesh, or even smaller, such as −50 mesh. In some instances, for example in ladle bottom injection, the solids should be minus 100 mesh.

The present process for the production of a solid calcium-slag additive material for use in steel desulfurization involves the initial formation of a molten mixture of lime, fluorspar and aluminum in a graphite lined induction furnace, the mixture blanketed with an inert gas, such as argon.

The formation of the molten mixture of lime, fluorspar and aluminum may be effected in alternate embodiments of the present process. In one embodiment, granulated lime is charged to the furnace and heated to remove all water. Such water removal is important before charging any aluminum, since hydrogen is known to be highly soluble in aluminum. The heating of the lime to about 650° C. will effect removal of any water present. There is then added to the heated lime, in the graphite lined furnace, the fluorspar, which fluorspar has also been dried and is water-free. The lime and fluorspar are heated to about 700°–750° C. and metallic aluminum is added.

Continued heating will effect reaction at about 1050°–1300° C., which reaction starts visibly and lasts for about five minutes Upon reaction of the mixture the temperature is raised to between about 1300°–1600° C., generally to about 1450° C., at which time there are two molten phases present in the furnace. The top phase in the furnace is a molten alloy of about 27.5% calcium and 72.5% aluminum, by weight, and comprises about 25% by weight of the molten mass within the furnace. The bottom phase is a calcium-slag containing calcium metal, fluorspar, aluminum oxide, some residual lime and impurities. The bottom phase, which contains no metallic aluminum, comprises about 75% by weight of the molten mass within the furnace. It is this bottom phase, which upon rapid cooling, produces this present additive composition.

In another embodiment of the process for producing the calcium-slag additive material, the lime and spar may be heated externally of the graphite lined furnace and added to molten aluminum contained in the furnace, to form the molten mixture. In such an embodiment, lime and spar are preheated in a heat exchanger, for example, a rotary kiln, or the lime may be freshly burnt lime, at 980°–1100° C., taken from the exit end of the kiln and charged to the graphite lined furnace. The preheated lime and fluorspar is added to a molten mass of aluminum in the furnace and the mixture heated to 1300°–1600° C. as in the previous embodiment to produce the two molten phases.

Regardless of the order of addition of the lime, fluorspar and aluminum, the heating to 1300°–1600° C. will produce in the furnace a top layer of a molten calcium-aluminum alloy and a bottom layer of a molten calcium metal-containing slag. The slag is tapped from the furnace and rapidly chilled to produce the solid calcium-slag. Rapid chilling is needed since, upon cooling, the solubility of calcium in calcium fluoride drops rapidly at first and then more slowly, to zero below the melting point of calcium. The product must thus be cooled rapidly from 1300° C. to ambient temperature, such as by quenching, or deposition onto a cooled belt or cooled rollers, or other rapid cooling method Referring now to the drawing, a schematic of a furnace and cooling means is illustrated for carrying out the present process, the drawing illustrating the tapping step of the process. An induction furnace 1, has water cooled copper coils 3 for induction current, and a graphite inner lining or crucible 5. A bottom nozzle insert 7 is provided for tapping the furnace, and a graphite core stopper rod 9, attached to movable means 11, is adapted to seal an orifice 13 in the nozzle insert 7 during preparation of the calcium-slag material, and rise to open the nozzle for tapping of the calcium-slag material. As aforedescribed, an argon blanket 15 is present above the materials within the furnace throughout the process.

In the drawing, the formation of the calcium-slag material has been effected, with a bottom phase of molten calcium-slag material 17 present and a top phase 19 of molten calcium-aluminum alloy present within the furnace. On raising the graphite stopper rod 9 from sealing engagement with the orifice 13 of the nozzle exit 7, the molten calcium-slag material is tapped from the bottom of the furnace 1 as a stream 2 which is directed on to chilling rolls, shown as two rotating, water cooled, copper driven rolls 23. The molten calcium-slag material is thus rapidly solidified as a thin sheet of brittle, solid material 25 and is then easily ground and screened to the particle size desired. The solidification and crushing of the calcium-slag material should be carried out in an atmosphere of very dry air or nitrogen.

The use of the furnace design illustrated in the drawing, having a graphite lining and a center graphite stopper rod, is especially useful in the present process. The graphite lining serves the double purpose of protecting the highly oxidizable materials from oxidation and does not interfere with the electromagnetic field, thus quickly rising in temperature and heating the non-metallic charge, lime and fluorspar. The central graphite stopper rod reduces significantly the open area of the induction furnace and alters the area within the furnace from a cylindrical shape to an annular shape, close to the graphite lining wall, removing the long heat transfer distance from wall to center of the furnace. The graphite stopper rod also aids in the electromagnetic current heating of the charge from the inside wall of the annular area, as well as serving as a stopper rod, to tap the slag material from the bottom of the furnace and stopping flow as soon as alloy appears.

The process is also operable in a semi-continuous manner wherein the steps of forming a molten mixture of lime, fluorspar and aluminum is effected and the mixture heated to produce the reaction of the mixture and formation of the two phases, with molten calcium-slag tapped from the bottom of the furnace. The molten heel, or top phase of calcium-aluminum alloy, is maintained in the furnace and fresh metallic aluminum and additional preheated lime and fluorspar is added thereto. The dissolved calcium content should rise higher in the slag due to the metallic calcium content of the alloy heel from the preceeding charge. Additional heating reaction, and tapping are then effected and the cycle repeated.

All of the furnace procedures are conducted, as described, under a blanket of argon and the furnace described requires no tilting. The non-tilting furnace construction simplifies considerably the construction of the electrical cables connected to the furnace and also enables elongating of the furnace body much beyond existing designs.

We claim:

1. A solid calcium-slag for use in the desulfurization of molten steel consisting essentially of 10–25% by weight calcium metal, 30–50% by weight $CaF_2$, 10–30% by weight $Al_2O_3$ and 10–30% by weight CaO.

2. The solid calcium-slag of claim 1 including 1-10% by weight of a compound of the group consisting of silicon dioxide, magnesium oxide, calcium carbide or mixtures thereof.

3. The solid calcium-slag of claim 1 consisting essentially of, by weight, 15% calcium metal, 45% $CaF_2$, 20% $Al_2O_3$, 18% CaO and 2% impurities.

4. The solid calcium-slag of claim 1 wherein said slag is in the form of discrete particles having a particle size minus 35 mesh.

5. A process for producing a solid desulfurizing calcium-slag for use in desulfurization of molten steel comprising:

forming a molten mixture of lime, fluorspar, and aluminum in a graphite-lined induction furnace under an inert atmosphere;

heating the mixture to a temperature of 1300°-1600° C. to form a top layer of a molten calcium-aluminum alloy over a bottom layer of a molten slag:

tapping the molten slag from the bottom of furnace and rapidly cooling the slag to form said solid desulfurizing slag.

6. The process as defined in claim 5 wherein said molten mixture is formed by melting lime and fluorspar in said furnace and adding thereto aluminum.

7. The process as defined in claim 5 wherein said molten mixture is formed by adding lime and calcium fluoride to liquid aluminum present in said furnace.

8. The process as defined in claim 5 wherein said inert atmosphere is argon.

9. The process as defined in claim 5 wherein said graphite-lined induction furnace has a central graphite stopper rod, such that the molten alloy and slag are formed in an annular ring between the lining and rod.

10. The process as defined in claim 5 wherein the process is rendered semi-continuous by adding additional lime, fluorspar and aluminum to the furnace, after tapping the molten slag, to form an additional molten mixture and repeating the steps of heating and tapping.

11. The process as defined in claim 5 wherein the molten slag is rapidly cooled by directing the slag from the bottom of the furnace onto chilling rolls.

* * * * *